US006907106B1

(12) United States Patent
McIntyre et al.

(10) Patent No.: US 6,907,106 B1
(45) Date of Patent: Jun. 14, 2005

(54) METHOD AND APPARATUS FOR PRODUCING RADIOACTIVE MATERIALS FOR MEDICAL TREATMENT USING X-RAYS PRODUCED BY AN ELECTRON ACCELERATOR

(75) Inventors: Raymond D McIntyre, Los Altos Hills, CA (US); Stanley W Johnsen, Palo Alto, CA (US); Marcel Marc, San Jose, CA (US); Michelangelo Delfino, Los Altos, CA (US); Edward Seppi, Portola Valley, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/379,439

(22) Filed: Aug. 23, 1999

(Under 37 CFR 1.47)

Related U.S. Application Data

(60) Provisional application No. 60/097,564, filed on Aug. 24, 1998.

(51) Int. Cl.[7] ..... G21G 1/12

(52) U.S. Cl. ..... 378/68; 376/157

(58) Field of Search ..... 378/68, 62, 37, 378/65, 206, 64, 69, 205, 143; 623/1.11; 376/156, 157

(56) References Cited

U.S. PATENT DOCUMENTS 3,777,124 A * 12/1973 Pavkovich
3,995,162 A * 11/1976 Peterson ..... 378/58
4,048,496 A * 9/1977 Albert ..... 378/45
5,059,166 A * 10/1991 Fischell et al. ..... 600/3
5,185,773 A * 2/1993 Blossfeld et al. ..... 378/53
5,213,561 A 5/1993 Weinstein et al.
5,365,562 A * 11/1994 Toker ..... 378/37
5,680,433 A 10/1997 Jensen
5,745,545 A * 4/1998 Hughes ..... 378/65
5,784,423 A * 7/1998 Lidsky et al. ..... 376/156
5,825,848 A 10/1998 Virshup et al.
6,285,739 B1 * 9/2001 Rudin et al. ..... 378/98.8
6,296,603 B1 * 10/2001 Turnlund et al. ..... 600/3

OTHER PUBLICATIONS

Weeks and O'Shea, "Production of radioisotopes by direct electron activation," 25 *Medical Physics* (4), pp. 488–492 (Apr. 1998).

* cited by examiner

*Primary Examiner*—Edward J. Glick
*Assistant Examiner*—Hoon Song
(74) *Attorney, Agent, or Firm*—Baker & McKenzie LLP

(57) ABSTRACT

An apparatus and method for irradiating target objects, especially medical stents for in vivo implantation. A linear accelerator provides a high energy electron beam that impinges upon and is received by an x-ray conversion target. The x-ray conversion target is activated by either a static or dynamically moveable electron beam to generate and emit an x-ray flux so as to efficiently intercept the target object. The x-ray flux is directed to the target object for a desired time period and is of sufficiently high energy to efficiently impart radioactive properties to the target object. Alternatively, the target object is positioned within the path of the x-ray flux or is translated within the path during irradiation. Mechanical transport assemblies such as a carousel, rotational and/or linear translator and/or movement tube system also may be provided.

53 Claims, 10 Drawing Sheets

METHOD AND APPARATUS FOR PRODUCING RADIOACTIVE MATERIALS FOR MEDICAL TREATMENT USING X-RAYS PRODUCED BY AN ELECTRON ACCELERATOR

Priority is claimed from U.S. Provisional Application Ser. No. 60/097,564, filed Aug. 24, 1998, entitled "Method and Apparatus for Producing Radioactive Materials for Medical Treatment Using X-rays Produced by an Electron Accelerator."

FIELD OF THE INVENTION

The present invention relates to a method and apparatus for imparting radioactive properties to target objects, such as implantable medical devices, by exposure of materials to radiation produced by an electron accelerator.

BACKGROUND OF THE INVENTION

In medical practice, a variety of apparatus and techniques have been developed for treating stenotic sites within body lumens. A complication of the known treatments is a condition known as restinosis (i.e., re-narrowing) of the stenotic region following treatment. This condition can be alleviated to some degree by the use of drugs and or by implantable medical devices, namely stents.

Stents come in a variety of shapes and sizes. Generally speaking, stents provide a structure having an opening, such as a generally hollow open cylinder. Some stents provide relatively thin walls made of metal or other suitable material for in vivo implantation, the walls defining through hole, such as for the flow through of a fluid such as blood or other body fluid. Typical vascular or coronary stents are constructed of an open mesh or lattice structure and are designed to be expandable following placement within a patient's body lumen, such as an artery, to facilitate increased blood flow at the diseased location. Even with a stent in place, restinosis has been known to occur at treated sites, such as due to the occurrence of excessive tissue growth.

It is also known that if the material comprising the stent is pre-processed so that it can provide a therapeutic treatment to the arterial wall that it is in contact with, then the probability of a reoccurrence of stenosis at the location may be reduced. This desired effect has been achieved through the introduction of certain drugs or by the emission of ionizing radiation, by the stent, or by a combination of these agents.

Various techniques are known for irradiating stents, such as those described in U.S. Pat. No. 5,059,166 and U.S. Pat. No. 5,213,561. Examples of the known techniques include having a spring coil stent irradiated so that it becomes radioactive, alloying a stent spring wire with a radioactive element, such as phosphorous 32, forming a stent coil from a radioisotope core material which is formed within an outer covering, and plating a radioisotope coating (such as gold 198) onto a stent.

One disadvantage of the known manufacturing techniques is the transport time between the site of manufacture and the site of use. Because of the need for transporting stents off-site using these known techniques, at least some of the radioactive dose imparted during the manufacturing process can be lost, especially since it is desirable to use radioactive materials having relatively short half lives. In the known techniques for irradiating stent materials, it is often required to use a reactor or high power charged particle accelerator, which are not understood generally to be readily available and which may not be conveniently located to the site of medical use. In order to compensate for the undesirable transport times and distances using the known techniques, users may need to resort to materials having longer half lives, or to imparting greater radioactive doses to the stent material during manufacture, in order to compensate for the delays between manufacture and use such as in hospitals. This leads to increased inefficiency and cost.

From the above, it is apparent that there is a need for systems to handle and transport medical devices so that they are exposed to x-rays of the appropriate energy level required to generate isotopes that are emitted from known and widely available compact industrial and medical high energy x-ray sources that may be located in hospitals at sites proximate to the points of use.

Relatively lower power, and more widely available and readily accessible industrial and medical linear accelerators are also known, such as the LINATRON® and the CLINAC® linear accelerators from Varian Associates, 3100 Hansen Way, Palo Alto, Calif. 94304. These linear accelerators have been used in industry for high-energy radiography or in hospitals for clinical radiation treatments. They may provide a directed beam of high energy x-rays at structures to be analyzed or at a diseased site for therapeutic purposes. It is known that these accelerators can generate an electron beam directed at an x-ray generating target, where the energy of the electrons in the beam is converted into x-ray flux. This phenomena is known as a bremstrahlung effect and is well known in atomic and high energy physics. An example of an x-ray generating target for use with the CLINAC® medical linear accelerator is described in commonly assigned U.S. Pat. No. 5,680,433.

It is therefore an object of the present invention to provide a more economical system for irradiating target objects for use in medical applications, such as stents, using compact and efficient x-ray sources and material handling systems. It is also an object of the present invention to provide a method of making radioactive stents which can be performed at distributed sites, such as within or close to hospitals or other facilities where they may be used.

It is another object of the present invention to provide an apparatus and method for efficient irradiation of materials using available medical linear accelerators or high energy x-ray radiographic accelerators.

It is a further object of the present invention to provide increased efficiency in irradiating materials.

It is another object of the present invention to provide an apparatus and method of making radioactive stents in a manner that could be done within the hospital or facility on an as-needed basis.

SUMMARY OF THE INVENTION

The present invention alleviates to a great extent the disadvantages of the known systems for manufacturing radioactive materials, such as stents for in vivo implantation, by providing a method and apparatus for irradiating target objects using x-rays alone. This description covers preferred apparatus and methods with which objects for use in medical treatment, such as stents, are processed to become radioactive, so as to be capable of emitting ionizing radiation having characteristics for effective therapy. In particular, an x-ray source is provided for generating high energy x-rays. The x-rays impinge upon and are received by a target object. The target object is either held stationary while being irradiated, or is translated by a translation assembly.

Various methods are described in further detail below by which stent devices may be efficiently activated using an accelerated beam of electrons to produce x-rays, which subsequently induce the gamma-neutron reaction in the stent material. The effectiveness of inducing radioactivity in the stent depends on several factors. For instance, the gamma-neutron reaction cross-section has a maximum between 15 and 20 MeV for most materials appropriate for use in this application. Thus, the accelerator used to produce the x-rays preferably produces electrons with energies adjustable to maximize the production of x-rays within this energy range. This preferably is in a range from approximately 20 MeV to 25 MeV.

In a preferred embodiment, a medical or industrial linear accelerator is used to generate a beam of high energy electrons. The beam impinges upon and is received by a primary x-ray conversion target, which generates an x-ray flux in a predominantly forward direction downstream of the electron beam source. One or more secondary target objects, such as pre-formed medical stents, are positioned downstream of the primary target, in a position to efficiently intercept the x-ray flux generated by the primary x-ray conversion target.

Other x-ray sources may be used as well, provided they produce x-rays of the appropriate energy level to generate radioisotopes.

The target objects may be stationary while being irradiated, or alternatively, may be translated in some fashion. If the target objects are held stationary, the radioactive dose imparted to them may be localized, depending on their orientation with respect to the x-ray flux. Alternatively, the electron beam and consequent x-ray flux produced by the primary target may be controlled to impart a distributed x-ray dose on the secondary target objects, which in turn results in a distributed and more uniform level of radioactivity in the target objects.

If the secondary target objects are translated during irradiation, the distribution of the x-ray dose may be controlled by controlling the movement of the target objects. For example, the target objects may be translated linearly to provide a longitudinal distribution of x-ray dose, and may also be rotated to impart a circumferentially distributed x-ray dose. The target objects also may be positioned on a rotating carousel, allowing a designated number of target objects to receive the bulk of the x-ray flux at any given time and also to promote cooling of the target objects by alternating target objects exposed to the x-ray flux at any given time. In another embodiment, the primary x-ray conversion target is incorporated in the secondary target object translation assembly. For example, the x-ray conversion target is formed within a rotating carousel, between an electron beam source and the target object. This embodiment also promotes cooling of the x-ray conversion target by alternating the area of the x-ray conversion target exposed to the electron beam at any given time.

The electron beam may be translated or shaped in any desired fashion onto the x-ray generating target. For example, multiple target objects may be irradiated by translating the electron beam or the x-rays relative to the target objects and to impinge upon and be received by one or more of the target objects at any one time. A feedback control system may also be provided in which the amount of x-ray radiation is monitored and the intensity, duration or other characteristics of the electron beam are controlled so as to control the amount of x-ray radiation applied to the target objects.

The above and other objects and advantages of the invention will be apparent upon consideration of the following detailed description, taken in conjunction with the accompanying drawings in which like reference characters refer to like parts throughout.

DETAILED DESCRIPTION OF THE INVENTION

Figure 1:
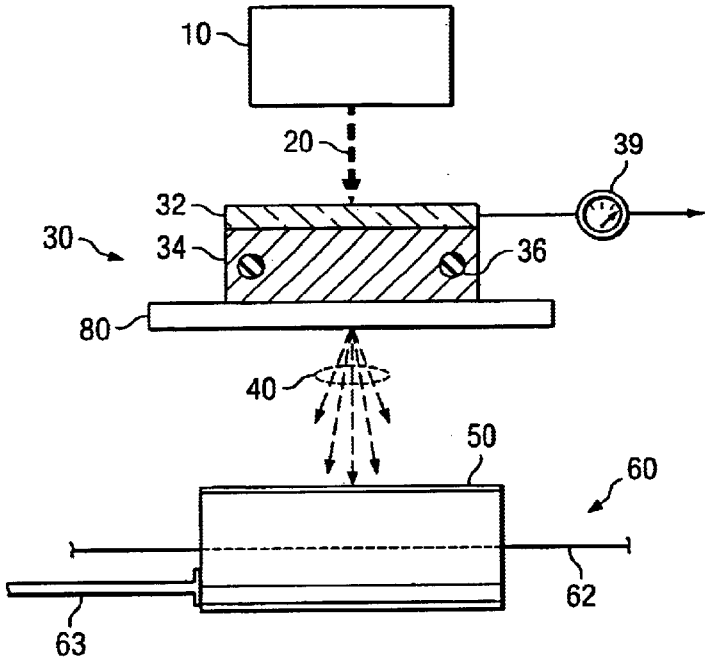
FIG. 1 is a diagram of an exemplary apparatus in accordance with the present invention.

In accordance with the present invention, a radioactive object or a radioactive medical device such as a stent for in vivo implantation is produced. Referring to FIG. 1, an accelerated beam or stream of electrons 20, such as provided by a high energy electron beam source 10 (for example, an electron linear accelerator), is used to generate high energy x-rays 40 by an x-ray conversion target 30. These emitted x-rays 40 also will be characterized as an x-ray beam or x-ray flux. The emitted x-rays 40 operate to impart radioactive properties to the ultimate target object 50.

Any ultimate target object 50 may be used. By way of illustration, metals and non-metals may be used, including stainless steel, aluminum, tungsten, tantalum, strontium, titanium, metal alloys, plated materials, multi-layer materials, composites, plastics, rubber and other polymers, and ceramic materials. In the preferred embodiment, the target object is a pre-formed medical device such as a stent.

As illustrated in FIGS. 1–4, an electron beam source 10 is used to generate and output a beam of electrons 20. Any device capable of achieving adequate beam intensity and appropriate energy levels may be used to create the beam of electrons, although it is preferred that a medical or industrial linear accelerator is used, for example the CLINAC® linear accelerator or the LINATRON® radiographic accelerator from Varian Associates. The x-ray conversion target 30, which includes an x-ray generating material or materials 32, receives the electron beam 20, such as by generally directing the electron beam 20 towards the x-ray conversion target 30. The design optimization of an appropriate x-ray conversion target 30 is well known in the art (for example, in radiation therapy devices). The x-ray conversion target 30 may be mounted in a stationary fashion in relation to the electron beam source 10 or may be movable in the path of the electron beam 20. The desired effect is to cause the electron beam 20 to impinge upon the x-ray conversion target 30. In this system, the x-rays 40 are emitted in a dispersed field, with the field being the strongest in the general direction of travel of the electron beam 20.

As is well known in the art, the x-ray generating material 32 in the x-ray conversion target 30 may be made of any material or group of materials suitable for emitting x-rays when receiving an electron beam 20 of a particular energy level.

Figure 2:
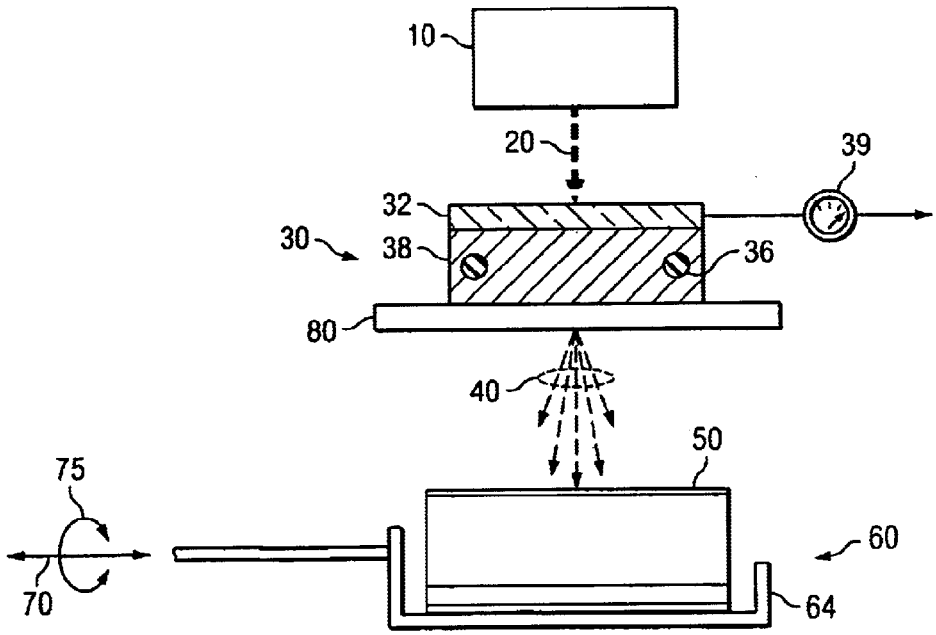
FIG. 2 is a diagram of an alternative exemplary apparatus in accordance with the present invention.
Figure 3:
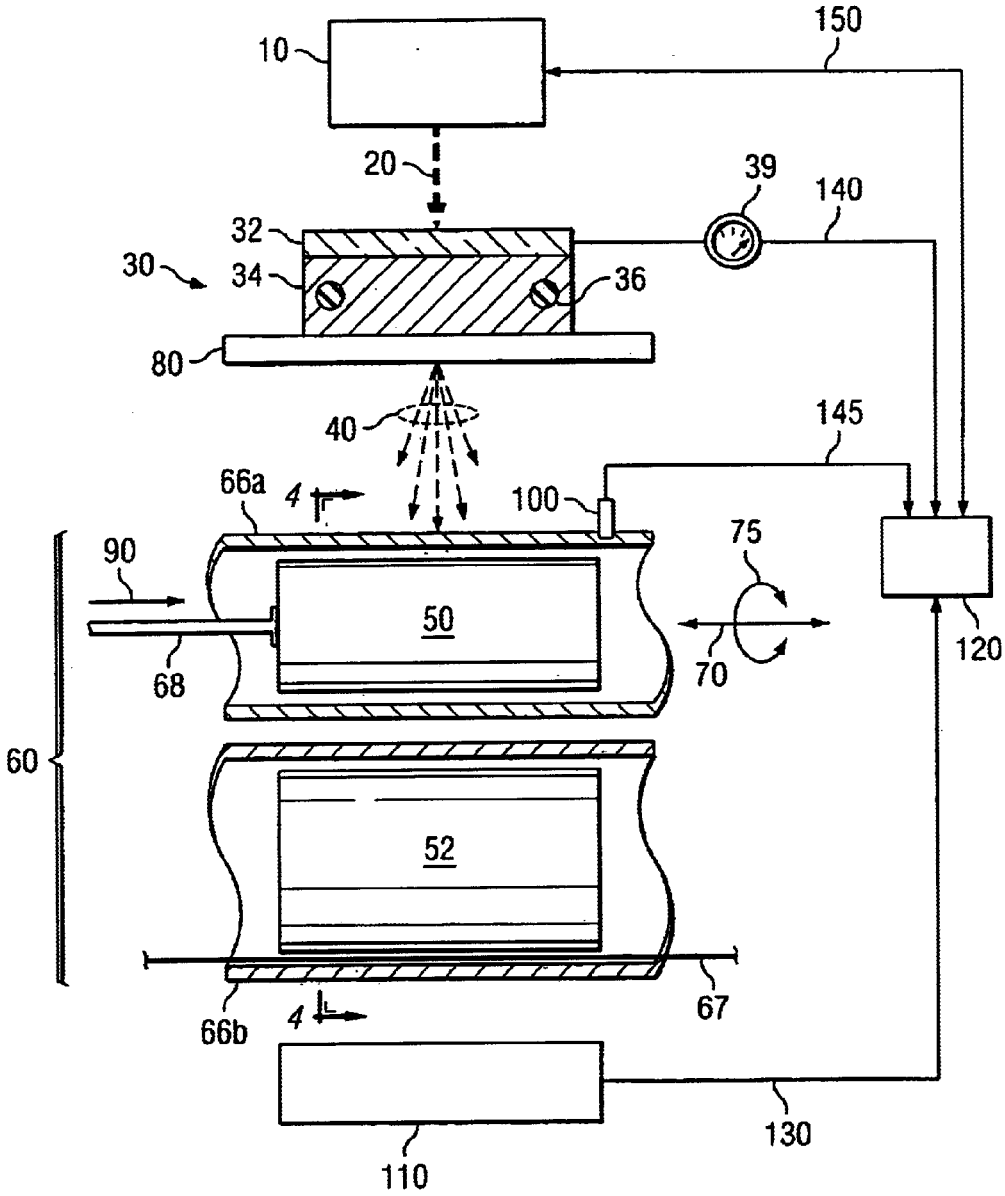
FIG. 3 is a diagram of an exemplary apparatus in accordance with the present invention including multiple translational devices and feedback control systems.

In a preferred embodiment, the x-ray conversion target 30 includes plural layers, for example layers 32 and 34, as illustrated in FIGS. 1 and 3 or layers 32 and 38 as illustrated in FIG. 2, although other layer arrangements or a single layer x-ray conversion target 30 also may be used. These layers preferably are selected to optimize the x-ray production efficiency of the x-ray conversion target 30 and most effectively absorb the power of the incident electron beam 20.

An electron absorption layer 34 optionally is included downstream of the x-ray generating material 32, i.e., between the x-ray generating material 32 and the ultimate target object 50. After passing through the x-ray generating material 32, all, or a substantial portion of, the remaining electrons are absorbed in the absorption layer 34. This absorption layer 34 may be constructed of any suitable material for absorbing the excess electrons. Preferably a relatively thick layer of a relatively low-atomic number material, for example copper or aluminum, is used.

Heat due to the electron power deposition in the conversion target 30 is conducted away using a cooling system 36, well known in the art.

A metering circuit 39 optionally may be included to monitor the electron beam current incident upon the x-ray conversion target. Any apparatus suitable for measuring electric current may be used. The metering circuit 39 optionally may be electrically connected to a control circuit 120, 130, 140, 150 (shown in FIG. 3) to control the electron beam output of electron beam source 10.

Figure 4:
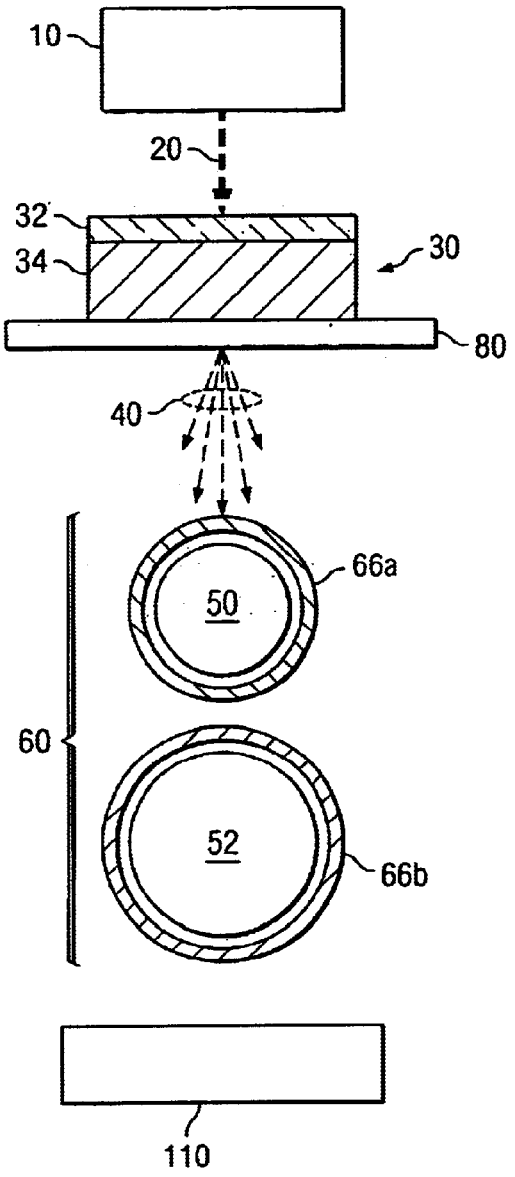
FIG. 4 is a cross section taken along line 4—4 of the exemplary apparatus illustrated in FIG. 3.
Figure 5:
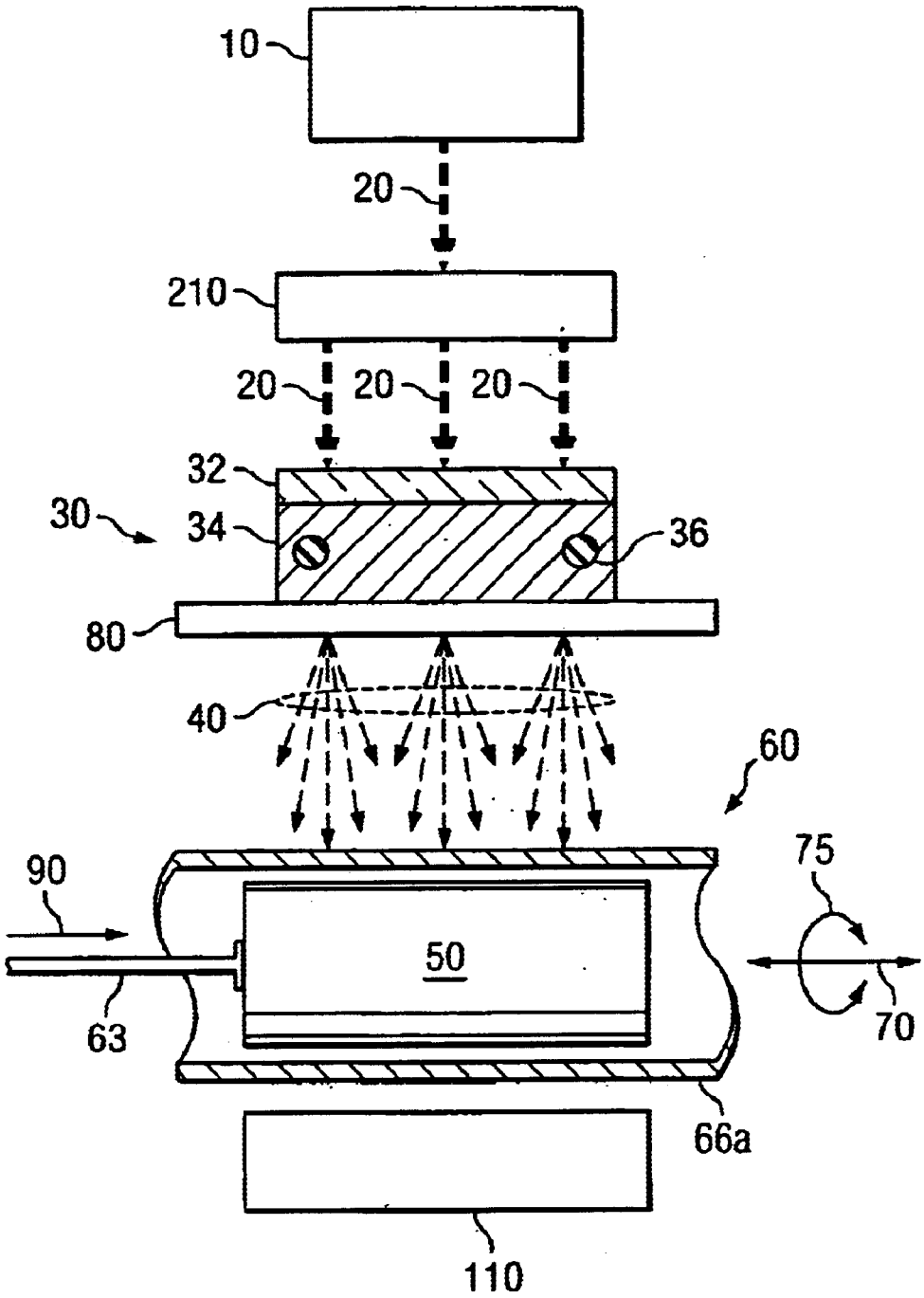
FIG. 5 is a diagram of an exemplary apparatus in accordance with the present invention including an electron beam distribution apparatus.

In one embodiment, a transport apparatus 60 receives the material 50 being irradiated and positions it as desired to efficiently receive the emitted x-ray flux 40. Any open or enclosed form of transport apparatus 60 may be used as long as it positions the target object 50 in the desired positions. For example, as illustrated in FIGS. 1 and 2, the transport apparatus 60 may include a filament 62 upon which the target object slides or is pushed, such as using push member 63. Alternatively, the transport apparatus may include a slider or gripper mechanism 64 (FIG. 2) or a conveyor belt 67 (FIG. 3). In another embodiment, the transport apparatus 60 includes a tube assembly 66*a*, 66*b* (FIGS. 3–5). The tube assembly includes at least one tube 66*a*, 66*b* receiving the target object 50, 52 within its interior portion, and a lateral and/or rotational positioning assembly 68 (FIG. 3) moving the target object 50 (or objects) within the tube 66*a* or 66*b* in a desired location to situate the target object, or objects, within the tube to receive the x-rays 40. Positioning assembly 68 may include any suitable apparatus so long as it can orient the target object 50 in a desired position within the tube assembly, for example, conveyor 67, filament 62, push member 63 or slider or gripper mechanism 64. The tubes 66*a*, 66*b* define any suitable cross section, including a circle, oval, square or other polygonal shape. The target object can be rotated as indicated by arrow 75 or linearly translated, as indicated by arrow 70 using the positioning assembly 68 (FIG. 3). Other motions also can be achieved as desired. Alternatively, any of the tubes 66*a*, 66*b* may be angled so that the target object 50 moves using gravitational force. When it reaches the desired position the angle may reduced so as to hold the target object 50 in place or to move slowly.

Tubes 66*a*, 66*b* preferably have an appropriate thickness for maximizing the x-ray intensity flux in the target, for the tube material selected. This effect, known as the build-up effect, is well known in the art. This x-ray generating material is in addition to the x-ray emitting x-ray conversion target 30. Alternatively, the x-ray conversion target 30 can be eliminated and replaced by the x-ray generator material incorporated in the tube 66*a*, 66*b*. In the latter embodiment, when the electron beam 20 impinges upon the tube 66*a*, 66*b*, x-rays are emitted into the interior of the tube and are received by any target object 50 in the path of this x-ray flux. In a preferred embodiment, tube 66*a* or 66*b* is as thin as possible to provide the required structural integrity, while maximizing photon flux to target object 50.

It should be understood that the positioning assembly 60 may include any structure orienting the target object 50 in the path of the emitted x-rays 40 and/or the electron beam 20. For example, the positioning member may retain the target object 50 in a fixed position and the irradiating apparatus may translate in relation to the target.

The target object 50 preferably is positioned within the portion of the x-ray beam 40 that has the greatest intensity. Likewise, the transport apparatus 60 and enclosed target object 50 may preferably be placed in close proximity to the x-ray conversion target so as to maximize the fluence of x-rays through the target object 50. It is preferred that the target object 50 be generally immobile in relation to the transport apparatus allowing for more precise locating of the target object 50 within the emitted x-rays 40. In the embodiment in which the transport apparatus 60 includes a tube, the target object 50 preferably is constrained from moving relative to the tube.

In the preferred embodiment, the material being irradiated 50 is a medical stent, although any other target objects may be irradiated as well. For example, material for constructing stents may be irradiated. Likewise, other implantable medical devices may be irradiated.

In the embodiment in which the target object 50 is a stent, the stent can be constructed with a generally cylindrical cross-section allowing it to be supported and also snugly fit within a tube shaped transport apparatus 60. In this embodiment, any suitable transport tube may be used. Preferably it is constructed with relatively thin walls. For example, the walls may have a thickness of generally 0.01 inches, and the transport apparatus preferably is constructed of a substance selected to minimize attenuation of the x-rays while not being subject to degradation of its material properties by exposure to the x-rays. Such a substance has a low atomic number and low density, for example, aluminum or carbon. Alloys of such substances also may be used.

In operation, the target object 50 within the transport apparatus 60, or the target object 50 and transports apparatus 60 together can be translated in the axial direction, as indicated by arrow 70, and about the axis, as indicated by arrow 75 while being irradiated to provide greater uniformity of the radioactivation within the target object 50. Alternatively, the transport apparatus 60 may dwell at a particular location so as to create an uneven radioactivation within the target object 50. In one embodiment, both the transport 60 and the target object 50 are independently movable. Alternatively, the target object 50 may be fixed in reaction to the transport 60.

The same translation motion of the target object 50 is also suitable for inserting and extracting the target object 50 from the transport 60. In the embodiment described above in which the target object 50 is a stent or stent material and the transport 60 is tubular, a continuous line of stents can be processed, i.e., stents are inserted into the transport tube 60 and are translated in direction 70 from one end of the tube to the other end of the tube 60. Alternatively, plural stents may be placed on the transport 60, and the transport 60 may be translated to irradiate the stents being transported.

The radioactivation produced in the target object 50 generally is dependent upon the energy and intensity of the x-ray beam 40 and the length of time the target object 50 is irradiated, i.e., placed within the a path of the x-rays 40, although other factors may influence irradiation as well.

A thermal shield 80 optionally is placed between the x-ray conversion target 30 and the transport apparatus 60 to diminish the amount of thermal radiation reaching the target object 50 from the x-ray conversion target 30. The use of a thermal shield is particularly appropriate in applications in which the target object 50 or the transport apparatus 60 will degrade if heated excessively.

Further cooling of the target object 50 or transport apparatus 60 is achieved by optionally providing a heat transfer fluid 90 within the interior of transport apparatus 60. This form of cooling is particularly suited to the embodiment in which the transport apparatus 60 includes a tubular structure and the fluid 90 is directed into the interior of the tube of the transport 60. Any suitable gas or liquid may be used, which can achieve a sufficient degree of heat transfer so as to maintain the material within a desired temperature range. Preferably the fluid 90 is selected to minimize corrosion of the apparatus, including the transport 60 and the target object 50. For example, gases such as helium or nitrogen are suitable as such a coolant.

A temperature monitoring device 100 may optionally be included to provide cooling feedback. Any form of thermostatic control may be used to maintain the required temperature of target object 50.

A radiation detector 110 optionally may be used. Any suitable detector may be used that can measure the flux of x-rays passing through the target object 50 and attendant apparatus, if any. One suitable radiation detector has an ionization chamber. The radiation detector 110 monitors the irradiation process and preferably provides information suitable for controlling the exposure of the target object 50 to the x-rays 40. This information provided by the radiation detector 110 also assists in maintaining a stable electron beam 20 energy level since the ratio of the x-ray flux 40 to the incident electron beam 20 current typically is proportional to the amount of energy. Thus, a feedback system is used in which the electron current in the x-ray conversion target 30 (such as measured by the metering circuit 39) is compared to the output of the radiation detector 110 so as to control the electron beam source 10 and stabilize the energy level of the electron beam 20. Any appropriate electronic or digital control known in the art may be used to provide this feedback system. Such a control system is illustrated in FIG. 3 in which the output of the radiation detector 110 is provided to controller 120 as illustrated with line 130. The output of metering circuit 39 also is provided to controller 120, as illustrated with line 140. Based on this output, controller 120 regulates the operational parameters of electron beam source 10 so as to control the energy level of electron beam 20. The connection between the controller 120 and electron beam source 10 is illustrated with line 150. It should be understood that the electron beam source optionally may provide feedback to controller 120 as well.

Optionally, the output of temperature monitoring device 100 can be provided to controller 120, as indicated by line 145. In this optional embodiment, the controller 120 controls the cooling system to maintain the desired temperature. Alternatively, a second controller (not shown) receives the output of the temperature monitoring device 100 and controls the cooling system.

In an alternate embodiment, plural transport apparatus 60 are used for transporting the target object 50 in the path of the x-ray beam 40. As illustrated in FIGS. 3 and 4, two tube assemblies 66*a* and 66*b*, are provided as part of the transport apparatus 60. An additional target object being irradiated 52 also is shown. In one embodiment, the multiple transports can include additional tubes; however, it should be understood that any form of transport apparatus may be used which can position the additional target object 52 in a desired location. The additional target object 52 can be any material suitable for irradiation, including for example a stent or other implantable medical device. In the embodiment illustrated in FIGS. 3 and 4, the additional tube assembly 66*b* and additional object 52 is irradiated by x-rays which pass through the upstream tube assembly and target object 66*a*, 50. Any number of transports (and transport tubes as illustrated) may be used. In this manner different sizes and types of transports or associated tubes can be used to accommodate a variety of target objects 50, 52 or target object shapes. Transport parameters, such as motion (indicated by arrows 70, 75) can be varied for each of the arrangements so that each target object 50 and 52 attains the desired radioactivity.

FIG. 4 illustrates a cross-sectional view taken along the axis of the tubes and enclosed materials 50, 52, illustrated in FIG. 3. This figure illustrates an embodiment in which the tubes (labeled 66(*a*) and 66(*b*) in the illustrations) of the transport apparatus 60 may be of different diameters and each preferably provides access for the respective enclosed target object 50, 52 to the portion of the x-ray beam of greatest intensity.

FIG. 5 illustrates another alternative embodiment of the invention. In this embodiment, an electron beam 20 may be applied to the x-ray conversion target in a variety of ways. In one example, the electron beam 20 can be provided in a static manner, in a particular shape. In another example, the electron beam 20 can be provided in a dynamic manner over a distributed region of the x-ray conversion target. For example, the electron beam 20 can be directed along a single line or over any other region using electron beam directing apparatus 210. Any such electron beam directing apparatus 210 may be used as long at it distributes the beam over the desired area. Examples of suitable electron beam directing apparatus 210 include beam optics, comprised of focusing magnets with static fields or alternatively magnets with time-varying fields. In one embodiment, the electron beam is directed by the electron beam directing apparatus 210 along a line which is oriented along the axis of the target object being irradiated 50, achieving a uniform flux of x-rays 40 from the x-ray conversion target 30 along the length of the target object 50. Any other distribution also may be generated. In one alternative embodiment, the target object 50 remains in a static position and is irradiated by directing the electron beam 20 with the electron beam directing apparatus 210 to cover the area to be irradiated. Any apparatus or component of the transport apparatus may be used to retain the target object 50 in a generally stable position, for example a pin or bar barrier. Alternatively, the transport apparatus may be controlled so as to retain the target object in a stable position, such as using any form of electronic control and motor or other motion imparting means.

Figure 6:
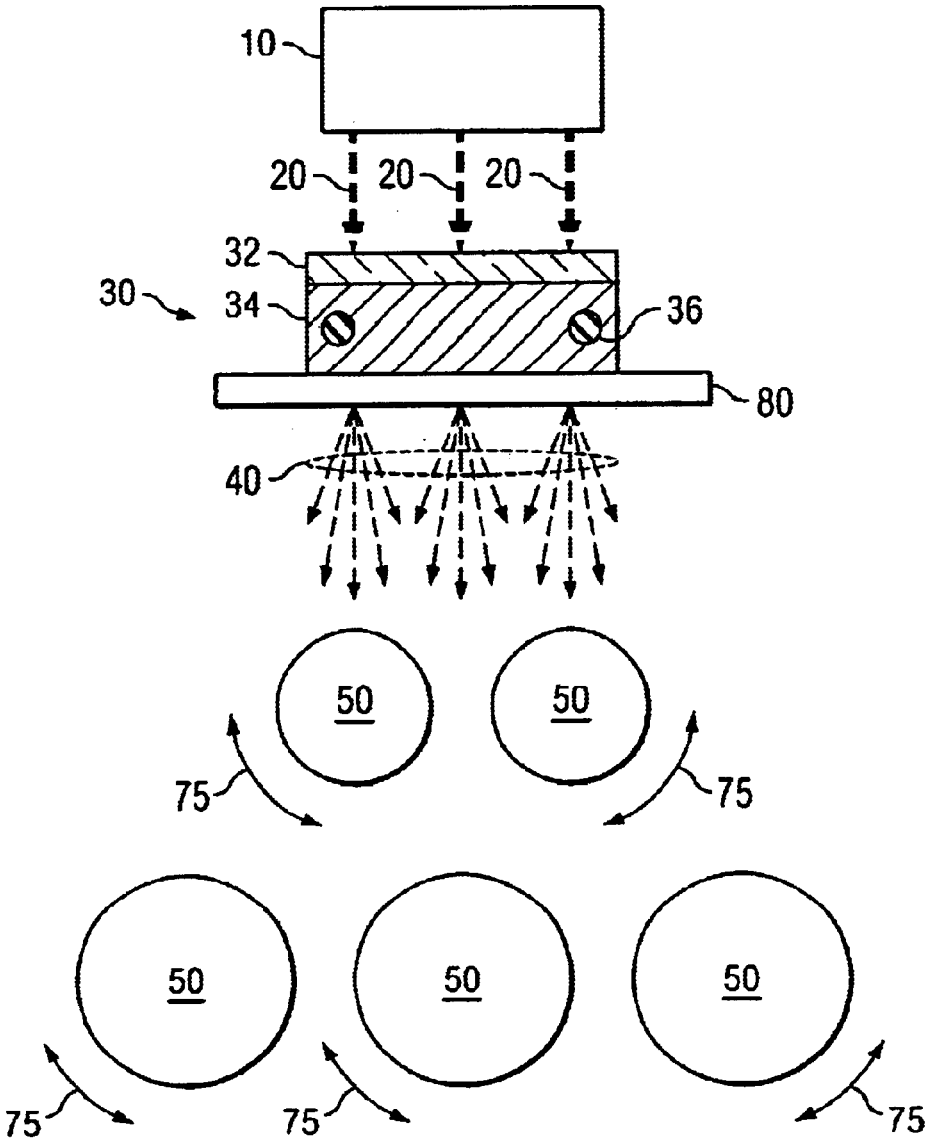
FIG. 6 is a diagram of an alternative exemplary apparatus in accordance with the present invention.

Using such electron beam distributing apparatus typically can result in multiple target objects 50, such as stents, being irradiated simultaneously, with or without motion of the target objects 50 during irradiation, resulting in an increased efficiency of utilization of the electron beam 20. One example is illustrated in FIG. 6, which includes the optional electron beam distributing apparatus 210.

Figure 7:
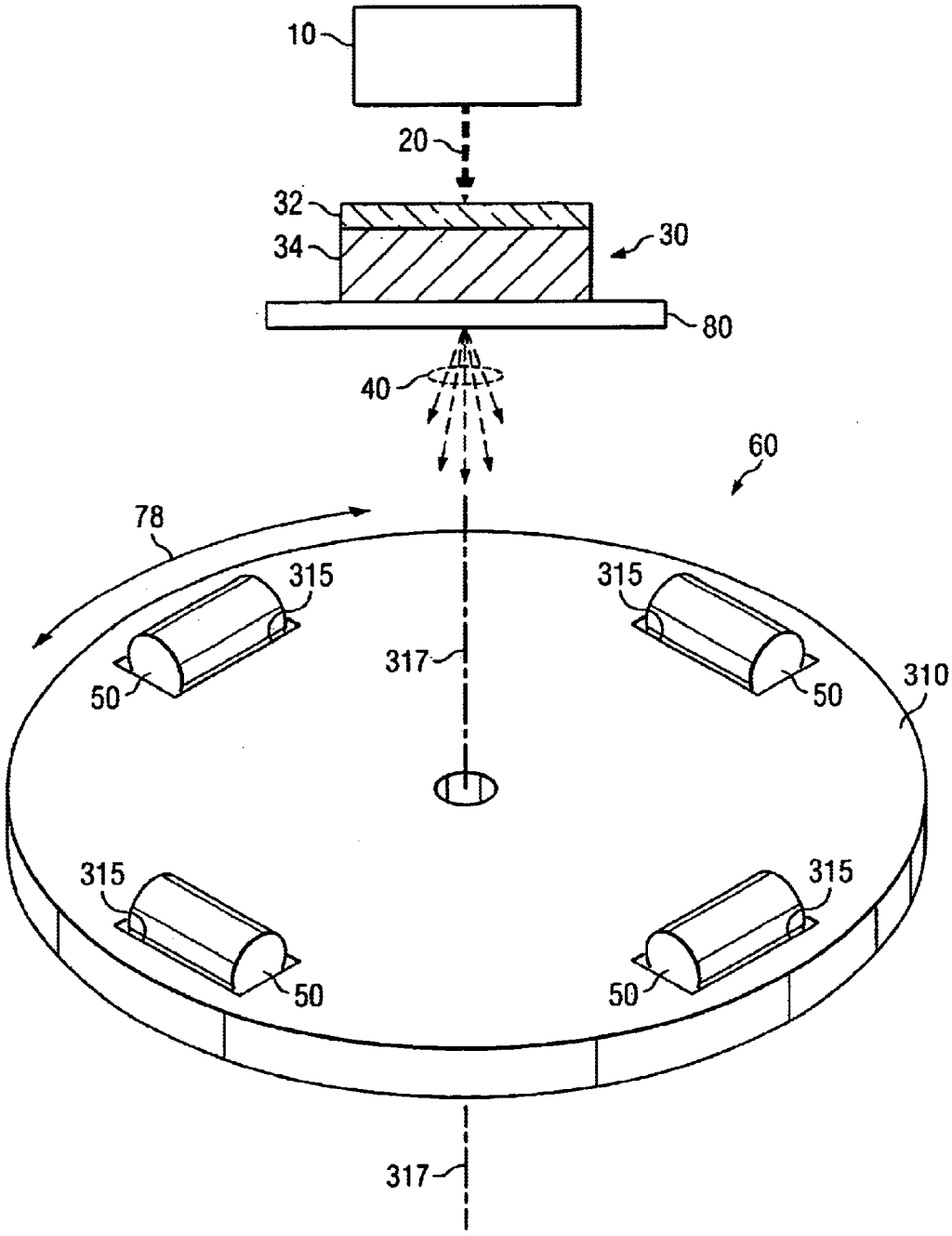
FIG. 7 is a diagram of an exemplary apparatus in accordance with the present invention including a carousel assembly for positioning target objects.

An alternate embodiment of the transport apparatus 60 is illustrated in FIG. 7. A turret or carousel 310 is used to position a collection of target objects 50, such as stents or other medical devices. The carousel includes a plurality of target mounts 315 capable of receiving and retaining in place at least one of the target objects 50. The target mounts may include any apparatus that can retain a target object 50 in relation to the carousel, such as an aperture, gripper or other pressure holder, recess, snap, clip and so on. The target objects 50 are positionable within the path of the x-rays emitted from the x-ray conversion target 30 by the rotation of the carousel. A rotational motion of the carousel 310 is indicated by arrow 78, indicating rotation about the axis indicated by reference numeral 317. In operation, the rotational motion 78 of the carousel translates the target objects 50 positioned on it to promote uniformity of irradiation. The electron beam source 10 preferably is positioned to provide the electron beam in the axial direction, although any position can be selected as long as the electron beam 20 and x-rays 40 are received by the target objects 50. Furthermore, while one target object 50 is positioned to receive the x-ray beam 40, another target object also positioned on the carousel 310, but away from the path of the x-ray beam 40 can be removed from the carousel 310, or otherwise processed. If an irradiated target object 50 is removed from the carousel 310 in this fashion, its place on the carousel 310 can subsequently be filled by another unirradiated target object 50. This lends itself well to continuous processing of target objects. The orientation of the carousel 310 with respect to the incident x-ray beam 40 and the orientation of the target objects 50 placed upon the carousel 310 preferably are optimized to maximize the utilization efficiency of the x-rays 40.

Figure 8:
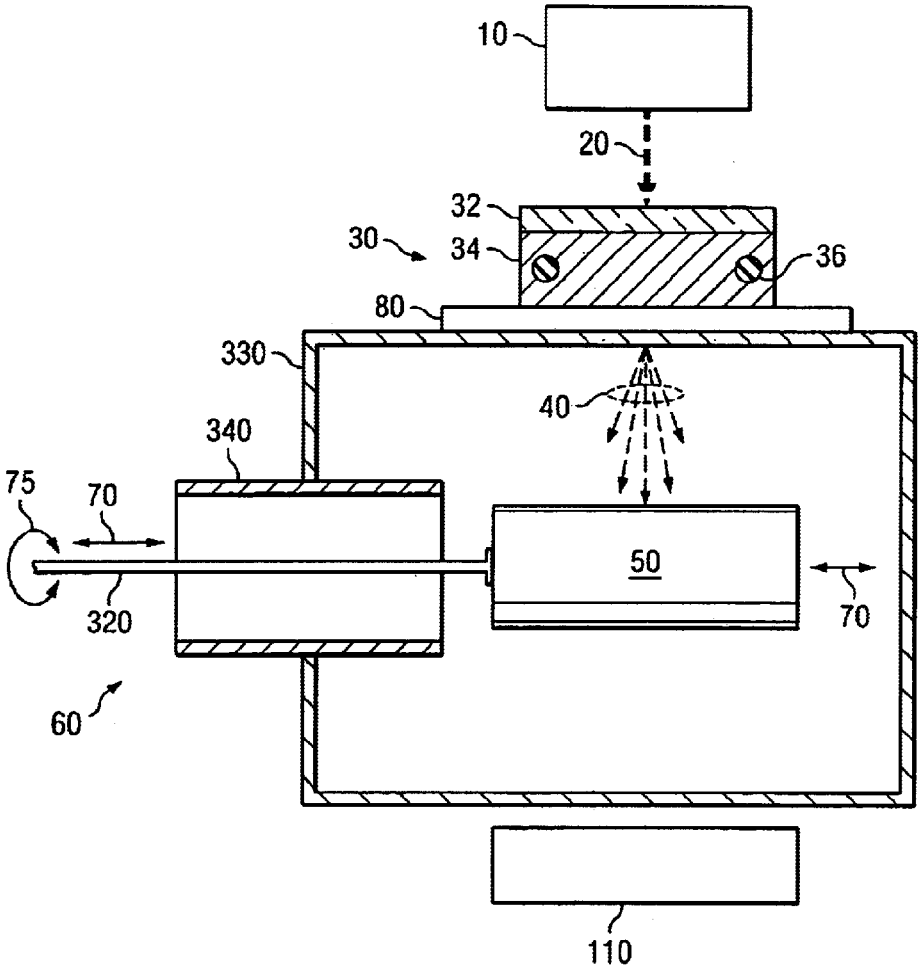
FIG. 8 is a diagram of an alternative exemplary apparatus in accordance with the present invention including a translation assembly for positioning target objects.

FIG. 8 shows an another embodiment in which a target object 50 is mounted on a positioning apparatus, such as a translation armature 320. The translation armature 320 is movable to position the target object 50 to impinge upon and receive the emitted x-rays 40. In other words, the translation armature 320 can act to suspend the target object 50 in a desired position for irradiation. Any form of translation armature 320 may be used, and any material also may be used as long as the form and material adequately support the target object 50, or target objects, positioned on the translation armature 320 and serve to position them for irradiation. For example, the translation armature may include a rod, wire, or other assembly suitable for retaining and translating a target object. It is preferred that the portions of the target armature 320 placed within the path of the x-ray flux 40 are constructed primarily of a low atomic number and low density material, such as aluminum, carbon or graphite to minimize x-ray attenuation. The translation armature 320 and mounted target objects 50 preferably can be translated axially, as indicated by arrow 70, and rotated, as indicated by arrow 75, to promote uniform exposure to the x-rays 40. The irradiation takes place in a chamber 330 into which a heat transfer fluid can be introduced to transfer heat from said chamber and/or prevent corrosion of the target object 50 during irradiation. The translation armature 320 may be introduced into the chamber 330 through an entry port 340. This port 340 assists positioning the target object 50 at a known and predetermined location within the x-ray emissions 40. Additional ports 340 optionally are provided to accommodate different size target objects 50 and to provide for insertion of plural target objects 50 within the chamber 330 for irradiation. A radiation detector 110 optionally is situated inside or outside of the chamber 330. The radiation chamber 330 optionally is mounted to or formed integrally with the x-ray conversion target 30. Alternatively, the radiation chamber 330 may be separated from the x-ray conversion target 30.

Figure 10:
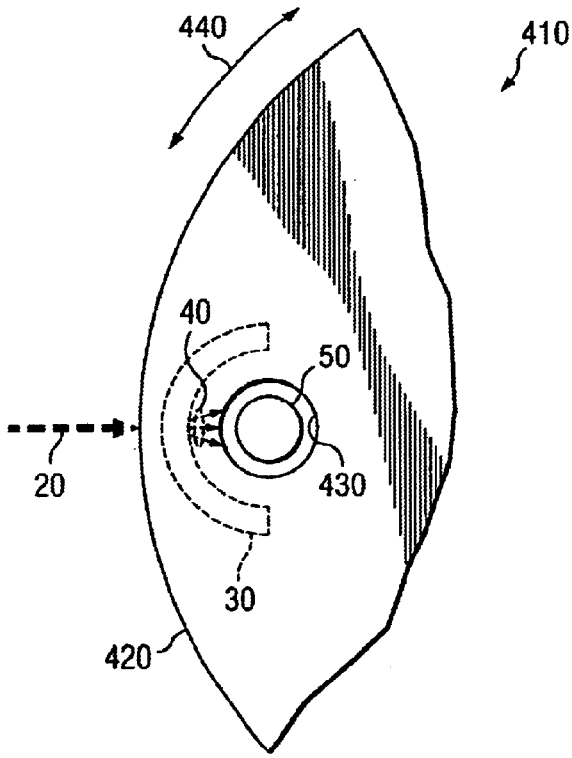
FIG. 10 is a detailed view of an exemplary apparatus in accordance with the present invention.
Figure 9:
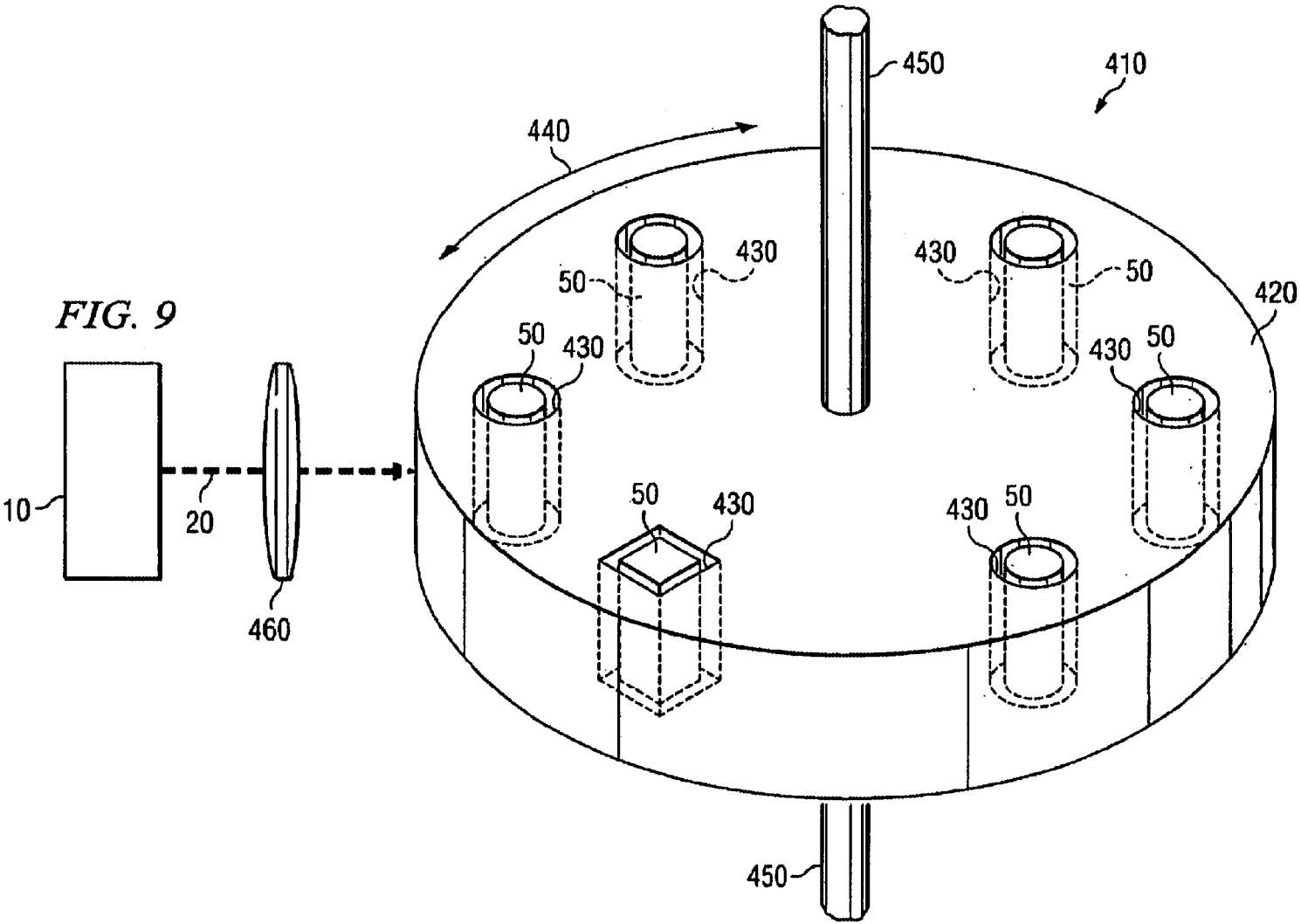
FIG. 9 is a diagram of an exemplary apparatus in accordance with the present invention including a carousel translation assembly incorporating an x-ray conversion target.
Figure 11:
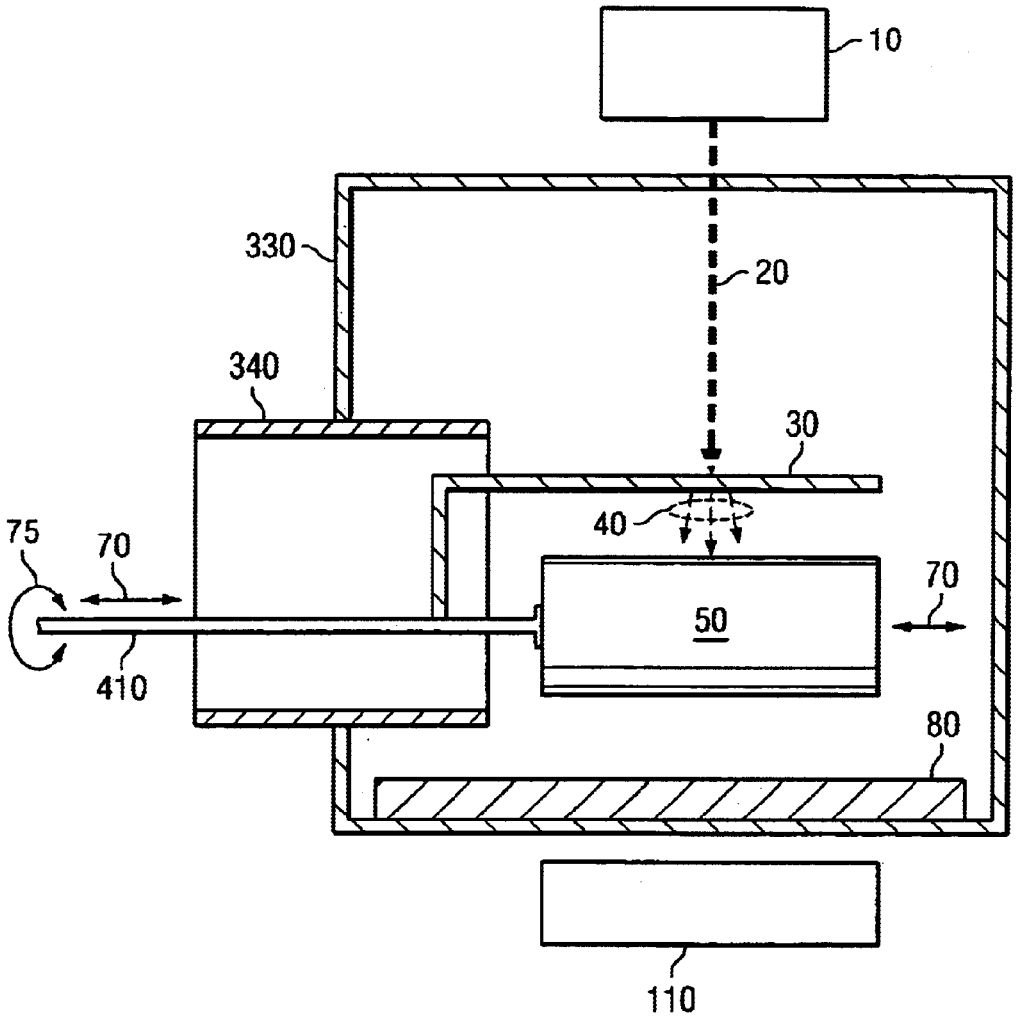
FIG. 11 is a diagram of an exemplary apparatus in accordance with the present invention including a linear assembly incorporating an x-ray conversion target.

It should be understood that the above embodiments summarized in this description are exemplary and that other embodiments of the present invention are also envisioned. For example, as illustrated in FIGS. 9–11, an alternative embodiment of the present invention includes an x-ray conversion target 30 that is translated in a path corresponding to the path of travel of the target objects 50. In this embodiment, a transport mechanism 410 translates both the x-ray conversion target 30 and the target objects 50 at the same time, or alternatively separate transport mechanisms are used to translate each of the x-ray conversion target 30 and the target objects 50. Target 30 generates an x-ray flux 40 towards the one or more target objects 50 on the transport mechanism 410. Likewise, a plurality of targets 30 may be provided, generating an x-ray flux received by the respective target objects 50.

Any apparatus may be used to translate the target objects 50 and the source target 30. As illustrated in FIGS. 9 and 10, in one embodiment, the transport mechanism includes a carousel 420. The carousel 420 includes source target mounts 430 receiving target objects 50 for translation in the desired fashion. Various appropriate target mounts may be used, which retain the target objects 50 on the carousel 420, such as grippers, snaps, clips or other pressure holders and apertures (as illustrated). The carousel 420 is rotatable in the directions indicated by arrows 440. The carousel 420 optionally includes a cooling mechanism such a fluid cooling via pipes 450. Likewise, the carousel may be rotably mounted on an axis corresponding to pipes 450. Preferably the pipes 450 include a set of concentric pipes, one of which carries a cooling fluid, preferably a gas, which cools the target objects 50 within the carousel 420 and the other of which carries a cooling fluid to cool the carousel 420 itself. To cool the carousel 420, it is preferred that channels be constructed within the carousel 420 to increase the surface area exposed to the cooling fluid thereby increasing the heat transfer to the cooling fluid. Channels also are included in the carousel 420 giving the target objects 50 cooling fluid access to the target mounts 430, giving access to the target objects 50 retained in them. It is preferred that the cooling gas be helium because it is understood to have a relatively high thermal conductivity. Another cooling gas is argon which is also favored, because it is inert and is understood to have a relatively high density, such as compared to helium.

In operation, an electron beam source 10 generates an electron beam 20, which optionally is directed using electron beam directing apparatus 460. Any form of beam optics well known in the art may be used to form the beam 20 to the desired shape or size, or optionally for translating the beam as desired. The beam 20 may be formed for example into an oval, or elongated in order to control the irradication and uniformity of irradiation of the target object. The beam 20 impinges on the carousel from any angle. It may impinge upon the carousel from the side, as illustrated in FIGS. 9 and 10, or alternatively, from any other direction, such as the top, as illustrated in FIG. 7, as long as the source target 30 is situated between the beam 20 and the target object 50 at the desired time.

For example, the carousel 420 itself or the circumferential outer edge of the carousel may be formed of a suitable material that generates an x-ray flux 40 upon receiving an appropriate electron beam 20. In this example, illustrated in FIG. 9, the carousel itself serves as the x-ray conversion or source target 30, generating an x-ray flux which is received by the target object 50 within the carousel. The electron beam from source 10 and optical beam directing apparatus 460 is directed into the radial edge of carousel 420 so as to optimally irradiate target objects 50, and so is not limited to being only normal to the carousel rotational axis.

The carousel 420 or that part of it constructed as an x-ray conversion target, may be fabricated of any material capable of efficiently generating an x-ray flux. For example, it may be constructed of a carbon-carbon fiber substrate that has embedded therein a suitable material for efficiently generating an x-ray flux while also providing for effective cooling of the target. Examples of target substrates doped with a high atomic number materials (i.e., a high Z material) are found in commonly assigned U.S. Pat. No. 5,825,848, entitled "X-ray Target Having Big Z Particles Imbedded in a Matrix." Alternatively, the x-ray conversion target may be comprised of a conventional high Z material such as tungsten, as generally known in the art.

An alternative example is illustrated in FIG. 10. The x-ray conversion target 30 is retained within the carousel 420 and surrounds at least a portion of the target mount 430. The x-ray conversion target 30 may have any shape preferably sufficient to ensure efficient generation of x-rays and corresponding coverage of target object 50 by the generated x-ray flux.

Other arrangements of the carousel 420 and x-ray conversion target 30 also may be used. By way of example, the x-ray conversion target 30 may surround the target mount 430, or the x-ray conversion target 30 may be generally planar, but also embedded in the carousel 420.

Another example of this embodiment of the invention is illustrated in FIG. 11. An x-ray conversion target 30 is mounted to translation assembly 410. The translation assembly 410 is movable to position the x-ray conversion target 30 to receive the electron beam 20, resulting in the generation of x-ray flux 40. The target object 50 is also positioned on the assembly 410, downstream of the x-ray conversion target 30, so as to receive the x-ray flux 40 emitted from the x-ray conversion target 30. Any form of translation assembly 410 may be used, and any materials also may be used to construct the translation assembly 410 so long as the form and material adequately support the x-ray conversion target 30 and target object or objects 50. X-ray conversion target 30 is constructed so as to allow ready access to the target object, also allowing the possibility that the target object 50 is rotated as indicated by 75 in FIG. 11. In this case, the x-ray conversion target 30 may be rotatably mounted to the translation assembly 410 and may be of a hollow cylindrical shape, so that it maintains its x-ray production efficiency when rotated. For example, the x-ray conversion target 30 may be mounted to the translation assembly 410 on bearings which enable the target object 50 to be rotated by the translation assembly 410, while the x-ray conversion target 30 maintains its x-ray flux output.

Figure 12A:
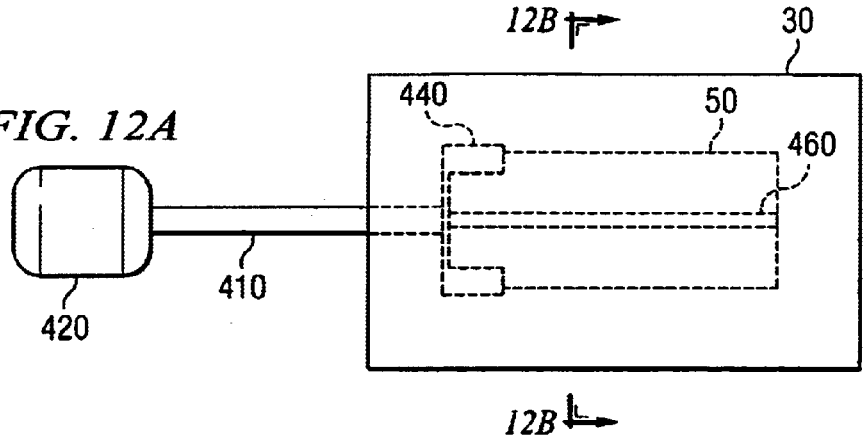
FIG. 12A is an illustration of an x-ray conversion target and translation assembly in accordance with an embodiment of the present invention.
Figure 12B:
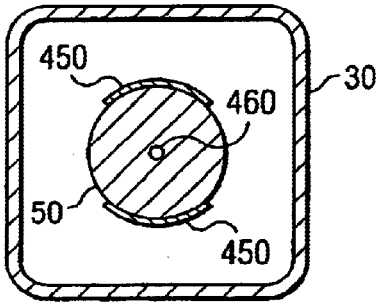
FIG. 12B is a cross-sectional view of the apparatus illustrated in FIG. 12A, taken along line B—B.

An illustrative example of an x-ray conversion target partially or fully surrounding the target object 50 is illustrated in FIGS. 12A and 12B. As illustrated therein, translation armature 410 is connected to motion assembly 420, which provides translational and/or rotational motion to the armature 410 for translating the target object as desired. In this embodiment, the direction of linear travel of the armature 410 is understood to be an axial direction and any direction at right angles to that axial direction is understood to be a radial direction. Any type of motion assembly may be used, such as any type of motor, gear and linkage apparatus, stepper motor, electric motor and so on. The x-ray conversion target 30 is shaped to ensure efficient irradiation of target object 50. Access to the target objection may be provided in any means, including partial disassembly of the source target 30, or by removal of 30 from the armature assembly 20. The target object 50 is retained to the translation armature 410 by any means, for example gripper, tongs, magnetic attraction, fingers, mandrel etc. As illustrated, a gripper device 440 having receiving fingers 450 can be used. A mounting core 460 is also illustrated.

The above-described features of the present invention can be combined together in any fashion. For example, the embodiments illustrated in FIGS. 8, 11, 12A and 12B can be combined and the embodiments illustrated in FIGS. 7 and 9 can be combined.

Figure 13:
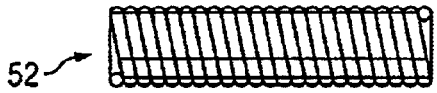
FIG. 13 is an illustration of a coil stent in accordance with the present invention.
Figure 14:
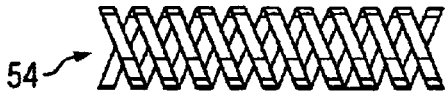
FIG. 14 is an illustration of a mesh stent in accordance with the present invention.
Figure 15:
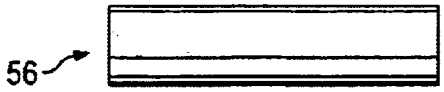
FIG. 15 is an illustration of a tubular stent in accordance with the present invention.

In the preferred embodiment, the target objects 50 are implantable medical devices, preferably stents. Any form of stent may be irradiated using the apparatus and process of the present invention, so long as the stent can perform the function of placement within a body lumen and retaining a required profile for a sufficient period as required for the desired treatment. Examples of suitable stent structures include a coil stent 52, illustrated in FIG. 13, a mesh or lattice stent 54, such as illustrated in FIG 14 and a tubular stent 56, illustrated in FIG. 15. The target object may be any other shape or size as well so long as it is compatible with the apparatus used for irradiating the target material.

Thus, it is seen that an apparatus and method for efficiently irradiating target objects, such as stents or other objects suitable for medical application is provided. One skilled in the art will appreciate that the present invention can be practiced by other than the preferred and other embodiments, all of which are presented in this description for purposes of illustration and not of limitation, and the present invention is limited only by the claims that follow. It is noted that equivalents of the particular embodiments discussed in this description may practice the invention as well.

What is claimed is:

1. A target irradiation system comprising:

an x-ray source operable to emit x-rays;

a target object capable of becoming radioactive upon receiving the emitted x-rays;

a relative positioning apparatus operable to translate the target object, positioned to receive the emitted x-rays, in a direction substantially transverse to the direction of the emitted x-rays.

2. The system as set out in claim 1 wherein said x-ray source includes means for emitting an x-ray beam including said x-rays and said system further comprising a means for shaping said x-ray beam.

3. The system as set out in claim 1 wherein said target object comprises an implantable medical object.

4. The system as set out in claim 1, wherein said relative positioning system includes a rotatable carousel at least a portion of which is impinged upon by and receives at least a portion of said x-rays, said rotatable carousel including at least one target mount for retaining at least one target object in fixed relation to said rotatable carousel.

5. The system as set out in claim 4 wherein said rotatable carousel has at least one rotation angle at which each said at least one target mount is impinged upon by and receives said x-rays emitted from said x-ray source and at least one rotation angle at which said at least one target mount does not receive said x-rays.

6. The system as set out in claim 1 wherein said relative positioning apparatus includes a tube assembly having:

a stationary member defining an interior path for receiving the target object; and a translation assembly for moving the target object along a path within said stationary member, said path positioned such that the target object receives said x-rays emitted from said x-ray source.

7. The system as set out in claim 6 wherein said stationary member defining an interior path is a tube.

8. The system as set out in claim 6 wherein said tube assembly further comprises a heat transfer apparatus supplying a heat transfer fluid within the interior of said stationary member defining an interior path.

9. The system as set out in claim 6 wherein said translation assembly includes linear and rotational translation apparatus.

10. The system as set out in claim 6 further comprising a plurality of members each defining an interior path and having an associated translation assembly for moving at least one target object along said interior path within each said member defining an interior path, each said interior path positioned to be impinged upon by said x-rays emitted from said x-ray source.

11. The system as set out in claim 6 wherein said stationary member defining an interior path includes an x-ray source activated by said beam of electrons to emit x-rays.

12. The system as set out in claim 1 wherein said relative positioning apparatus includes a tube assembly having:

a substantially stationary tube defining an internal target object conduit path; and a translation assembly for moving the target object within said stationary tube along a desired path positioned to be impinged upon by said x-rays emitted from said x-ray source.

13. The system as set out in claim 1 further comprising:

at least one sensor measuring parameters selected from a group including electron beam current, temperature, and radiation; and a control circuit controlling the electron beam provided by said electron beam source based on said parameters measured by said at least one sensor.

14. The system as set out in claim 13 wherein said at least one sensor includes a radiation detector situated downstream of said relative positioning apparatus.

15. The system as set out in claim 13 wherein said at least one sensor includes a metering circuit measuring the electric current received in an x-ray conversion target.

16. The system as set out in claim 13 wherein said at least one sensor includes a temperature monitoring device measuring the temperature in proximity of said relative positioning apparatus.

17. The system as set out in claim 13 wherein said at least one sensor includes:

a radiation detector situated downstream of said relative positioning apparatus; and a metering circuit measuring the electric current received in an x-ray conversion target.

18. The system as set out in claim 1 further comprising a radiation detector downstream of said relative positioning apparatus.

19. The system as set out in claim 1 wherein said x-ray source is further configured to generate an x-ray beam including said x-rays by striking an electron beam on an x-ray conversion target, said irradiation system further comprising a metering circuit measuring an electron beam current of said electron beam.

20. The system as set out in claim 1 wherein said relative positioning apparatus includes a fixed positioning member retaining at least one target object in generally fixed relation to said x-ray source while positioned in the path of said x-rays.

21. The system as set out in claim 1 further comprising an electron beam directing apparatus between the electron beam source and an x-ray conversion target.

22. The system as set out in claim 21 wherein said electron beam directing apparatus includes a magnetic means for directing the electron beam.

23. The system as set out in claim 1 further comprising a heat transfer system conducting heat away from an x-ray conversion target.

24. The system as set out in claim 23 wherein said heat transfer system includes a conduit for conveying a heat transfer fluid.

25. The system as set out in claim 1 further comprising a thermal shield between an x-ray conversion target and at least one target object positioned on said relative positioning apparatus.

26. The system as set out in claim 1, further comprising an x-ray conversion target includes a plurality of layers wherein:

at least a first one of said layers comprises x-ray generating material;

at least a second one of said layers comprises an electron absorption apparatus between said x-ray generating material layer and said at least one target object positioned by said relative positioning apparatus.

27. The system as set out in claim 26 further comprising a thermal shield between said x-ray conversion target and said relative positioning apparatus.

28. The system as set out in claim 1 further comprising a chamber downstream of the x-ray source, said chamber including a target object entry port and wherein said relative positioning apparatus includes a translation armature extendable through said target object entry port.

29. The system as set out in claim 28 wherein said translation armature includes a linearly translatable member mounting for receiving said at least one target object wherein the linearly translatable member defines a translation path including a first position within said chamber impinged upon by said x-rays, and a second position outside said chamber wherein said at least one target object is movable on sad linearly translatable member between said first position and said second position, through said entry port.

30. Apparatus for irradiating a target object comprising:

an electron beam source providing a beam of electrons;

a positioning assembly including a rotatable carousel having an axis of rotation and a radial edge, the electron beam source directing said beam of electrons to impinge upon and be received by the radial edge of said rotatable carousel, said rotatable carousel including:

an x-ray conversion target in the rotatable carousel activated by said beam of electrons to emit x-rays;

a mounting station receiving at least one target object, said mounting station receiving x-rays emitted by said x-ray conversion target.

31. The apparatus as set out in claim 30 wherein said positioning assembly includes a plurality of mounting stations each mounting at least one target object in a generally fixed relation to said x-ray conversion target.

32. The apparatus as set out in claim 30 wherein said election beam is directed perpendicular to the axis of rotation of said rotatable carousel.

33. The apparatus as set out in claim 32 wherein said x-ray conversion target is located in said rotatable carousel.

34. The apparatus as set out in claim 32 wherein said carousel includes a carbon-carbon fiber doped with said x-ray generating material.

35. The apparatus as set out in claim 30 wherein said rotatable carousel is rotatable from a first position in which said mounting station is aligned with said electron beam and a second position in which said mounting station is outside the path of said electron beam.

36. The apparatus as set out in claim 30 further comprising a heat transfer system conducting heat away from at least one of the carousel, x-ray conversion target and target object.

37. The apparatus as set out in claim 36 wherein said heat transfer system includes a conduit for conveying a heat transfer fluid.

38. The apparatus as set out in claim 36 wherein said heat transfer system includes a plurality of fluid conduits in said rotatable carousel.

39. The apparatus as set out in claim 30 further comprising an electron beam directing apparatus between said electron beam source and said carousel.

40. A target irradiation system comprising:

an electron beam source providing a beam of electrons;

a positioning assembly including a linearly movable translation armature, said translation armature mounted to said positioning assembly at least for linear motion in an axial direction substantially transverse to the direction of the provided beam of electrons, and said translation armature including a mounting apparatus mounting at least one target object;

an x-ray conversion target mounted on said translation armature between said translation armature and said electron beam source, wherein said x-ray conversion target defines a radial access region providing access to said at least one target object and said x-ray conversion target includes an x-ray generating material activated by said beam of electrons to emit x-rays; and wherein said at least one target object is capable of becoming radioactive upon receiving the emitted x-rays.

41. The system as set out in claim 40 wherein:

said positioning assembly includes a means for moving said x-ray conversion target mounted on said translation armature between a first position range impinged upon by said electron beam, and a second x-ray conversion target position not impinged upon by said electron beam; and said positioning assembly includes a means for moving said at least one target object mounted on said mounting apparatus between a first target object position range corresponding to said first x-ray conversion target position range at which said at least one target object is positioned in the path of x-rays emitted by said x-ray conversion target and a second target object position not impinged upon by said electron beam.

42. The system as set out in claim 40 further comprising an irradiation enclosure defining an interior space wherein said first x-ray conversion target position and said first target object position are within the interior space defined by said irradiation enclosure and said second x-ray conversion target position and said second target object position are outside said irradiation enclosure.

43. The system as set out in claim 40 wherein said x-ray conversion target is substantially planar.

44. The system as set out in claim 40 wherein said x-ray conversion target has an arcuate cross-sectional shape.

45. A target irradiation system comprising:

an electron beam source providing a beam of electrons on a path;

a rotatable carousel including:

a plurality of x-ray conversion targets circumferentially positioned on said carousel, each of said plurality of x-ray conversion targets including an x-ray generating material activated by said beam of electrons to emit x-rays when positioned in the path of the electron beam;

a plurality of mounting stations to receive at least one of said target objects, each of said mounting stations associated with one of said x-ray conversion targets and located on said carousel downstream its associated x-ray conversion target in the path of x-rays emitted from the associated x-ray conversion target when the x-ray generaing material of the associated x-ray conversion target is activated by said beam of electrons to emit x-rays; and a target object capable of becoming radioactive upon receiving the emitted x-rays.

46. A target irradiation system comprising:

an electron beam source comprising a medical linear accelerator and providing a beam of electrons;

an x-ray conversion target in fixed relation to the electron beam source in the path of the beam of electrons from the electron beam source, the x-ray conversion target including an x-ray generating material activated by the bean of electrons to emit x-rays;

a target object capable of becoming radioactive upon receiving the emitted x-rays;

an electron beam directing apparatus between the electron beam source and the x-ray conversion target; and a retaining apparatus retaining the target object in relation to said electron beam source in a position to receive the emitted x-rays along a longitudinal surface thereof positioned in a direction substantially transverse to the direction of the emitted x-rays.

47. A target irradiation system comprising:

an x-ray source means for generating x-rays; and a positioning means for positioning at least one target object in the path of x-rays generated by said x-ray source means, including means for moving the at least one target object in a direction substantially transverse to the direction of the generated x-rays generated by said x-ray source means; and wherein the at least one target object is capable of becoming radioactive upon receiving the generated x-rays.

48. The system as set out in claim 47 wherein said x-ray source comprises:

an electron beam source means providing a beam of electrons;

an x-ray conversion target means in fixed relation to the electron beam source in the path of the beam of electrons from the electron beam source, the x-ray conversion target including an x-ray generating material means for emitting x-rays when activated by said beam of electrons.

49. The system as set out in claim 47 wherein said positioning means comprises a carousel including target object mounting means.

50. A target irradiation system comprising:

an electron beam source providing a beam of electrons;

a positioning means including a means for linearly translating a translation armature for linear motion in an axial direction substantially transverse to the direction of the provided beam of electrons, and said translation armature including a mounting means for retaining at least one target object;

an x-ray conversion target means mounted on said translation armature between said translation armature and said electron beam source, wherein said x-ray conversion target means defines a radial access region providing access to said at least one target object and said x-ray conversion target includes an x-ray generating material activated by said beam of electrons to emit x-rays; and wherein the at least one target object is capable of becoming radioactive upon receiving the emitted x-rays.

51. A method of irradiating a target object comprising:

providing abeam of electrons;

positioning an x-ray conversion target in fixed relation to said beam of electrons and impinging upon and receiving said beam of electrons;

emitting x-rays from the x-ray conversion target when activated by said beam of electrons;

selecting a target object capable of becoming radioactive upon receiving the emitted x-rays;

moving said target object in relation to said x-ray conversion target in a direction substantially transverse to the direction of the emitted x-rays and in the path of the x-rays emitted by said x-ray conversion target.

52. A method of irradiating a target object in a rotatable carousel having an axis of rotation comprising:

selecting a target object capable of becoming radioactive upon receiving x-rays;

placing the target object in an aperture in the rotatable carousel;

providing a beam of electrons substantially perpendicular to said axis of rotation of the carousel;

activating an x-ray generating material in the rotatable carousel with said beam of electrons to emit x-rays; and impinging at least a portion of said x-rays upon the target object placed in the aperture.

53. An irradiated medical stent produced using a process comprising the steps of:

providing a beam of electrons;

providing an x-ray conversion target in fixed relation to the beam of electrons;

emitting x-rays from the x-ray conversion target when activated by said beam of electrons; and moving at least one medical stent in the path of said x-rays emitted by the x-ray conversion target and in a direction substantially transverse to the direction of the emitted x-rays, said at least one medical stent becoming irradiated when receiving the emitted x-rays.

* * * * *